United States Patent [19]

Todd

[11] 4,084,637

[45] Apr. 18, 1978

[54] METHOD OF PRODUCING VISCOUS MATERIALS FROM SUBTERRANEAN FORMATIONS

[75] Inventor: John C. Todd, Dallas, Tex.

[73] Assignees: Petro Canada Exploration Inc.; Canada-Cities Services, Ltd.; Imperial Oil Limited, all of Canada

[21] Appl. No.: 751,058

[22] Filed: Dec. 16, 1976

[51] Int. Cl.[2] ..... E21B 43/24

[52] U.S. Cl. ..... 166/245; 166/248; 166/60; 166/272; 166/256

[58] Field of Search ..... 166/248, 302, 303, 272, 166/256, 57, 60, 245

[56] References Cited

U.S. PATENT DOCUMENTS

| | | | |
|---|---|---|---|
| 2,795,279 | 6/1957 | Sarapuu | 166/248 |
| 2,818,118 | 12/1957 | Dixon | 166/248 |
| 3,547,193 | 12/1970 | Gill | 166/248 |
| 3,605,888 | 9/1971 | Crowson et al. | 166/248 |
| 3,642,066 | 2/1972 | Gill | 166/248 |
| 3,848,671 | 11/1974 | Kern | 166/248 |
| 3,862,662 | 1/1975 | Kern | 166/248 |
| 3,948,319 | 4/1976 | Pritchett | 166/248 |

*Primary Examiner*—Stephen J. Novosad
*Attorney, Agent, or Firm*—Hubbard, Thurman, Turner, Tucker & Glaser

[57] ABSTRACT

A method of producing viscous materials from subterranean formation comprises a plurality of steps. At least two wells are drilled and completed into the subterranean formation that contains the viscous material. At least one of the wells is completed as an injection well and one of the wells is completed as a production well. A plurality of electrode wells are drilled into the subterranean formation with the plurality of electrode wells being generally arranged in a pattern to define at least one path between the production well and the injection well with the length of the path being substantially greater than the distance between the production well and the injection well. The electrode wells are spaced apart along the path at distances that are substantially less than the distance between the production well and the injection well. Thereafter, a voltage is applied across the adjacent pairs of electrode wells to thereby cause an electrical current to pass through the subterranean formation between each adjacent pair of the electrode wells. As the electrical current passes through the subterranean formation, the viscous material is heated to thereby lower the viscosity of such material. Following the heating of the subterranean formation in the vicinity of the path formed by the electrode wells, a driving fluid is injected through the injection wells to thereby migrate along the path and force the material having a reduced viscosity toward the production well. The material is produced through the production well and by continuing to inject a heated fluid through the injection wells, substantially all of the viscous material in the subterranean formation can be heated to lower its viscosity and be produced from the production well.

9 Claims, 6 Drawing Figures

METHOD OF PRODUCING VISCOUS MATERIALS FROM SUBTERRANEAN FORMATIONS

BACKGROUND OF THE INVENTION

This invention relates to an improved method for producing highly viscous materials from subterranean formations. In another aspect, this invention relates to an improved method for preheating viscous materials contained in a subterranean formation whereby the materials can be produced from such subterranean formation. In still another aspect, this invention relates to an improved method for recovering viscous materials from a subterranean formation by selectively preheating a portion of the formation and, thereafter, recovering substantially all of the viscous materials from said formation.

For many years, it has been known that large deposits of very viscous materials, such as tar, heavy crude oil, and the like, are present in subterranean formations. For example, the presence of vast quantities of tar sands has been discussed in detail in Kirk-Othmer Encyclopedia of Chemical Technology, Second Edition, Anthony Standen, Editor, Interscience Publishers, New York, 1969, Vol. 19, pgs. 682–732. Such materials are known to have viscosities greater than at least 5,000 centipoises and the majority of such materials have a viscosity in the range of 500,000 to 5,000,000 centipoises at 50° F.

With the realization that conventional energy supplies, such as low viscosity crude oil, natural gas and the like, are being depleted at a rapid rate, as well as certain poetical and economic considerations that have increased the cost of conventional energy sources, there is a considerable amount of interest in recovering and utilizing such viscous materials.

As a result of the increased interest in recovering such viscous materials, many techniques have been suggested for such recovery. One technique has been a suggestion of mining deposits containing such viscous materials and, thereafter, separating the viscous materials, such as tar, heavy crude oil, and the like, on the surface. Unfortunately, such a suggestion has not met with widespread use because many of the subterranean formations are very deep within the ground, thereby adding to the cost of the recovery of such materials. Additionally, it is necessary to handle large volumes of the mined material to extract, or remove, the viscous material from sand, clays, and the like. Therefore, it is evident that conventional mining of materials that contain the viscous tar or oil components is extremely expensive and uneconomical.

The prior art discloses several different techniques for an in situ removal of viscous material such as tar and oil components from subterranean formations. Such techniques include a variety of flooding techniques, such as fire floods, exotic emulsion steam drives, atomic explosions and the like. Despite the large number of techniques that have been tried, most of them have met with little success because of the expense and the low percent of recovery of the viscous materials within the subterranean formations.

Recently, other techniques for recovering viscous materials from subterranean formations, such as the recovery of tar from subterranean tar sand formations have been suggested and utilized with some limited success. For example, a relatively recently disclosed technique involves the use of electrical current to preheat a subterranean formation to elevate the temperature of the formation to a point where the viscosity of the tar or oil components is lowered. By preheating the formation, the viscosity can be decreased to a level where the tar or oil components will flow and to a point where they can be driven from the subterranean formation by means of injection and production wells that have been drilled into the subterranean formation. In such procedures, the injection and production wells are adapted to receive an electrode means and electrical current can be passed through the subterranean formation between the injection wells and the production wells. This type of procedure for recovering viscous materials from subterranean formations is discussed in such patents as U.S. Pat. Nos. 3,848,671, issued Nov. 19, 1974; 3,948,319, issued Apr. 6, 1976; 3,642,066, issued Feb. 15, 1972; and 3,862,662, issued Jan. 28, 1975.

The above-mentioned prior art methods for including electrode means in production and injection wells to preheat the subterranean formation and, thereby, lower the viscosity of the viscous material contained therein have several drawbacks. For example, the production and injection wells are normally drilled on spacings whereby the electrodes are widely separated and spaced apart. Thus, when electrical currents are passed through the formation to preheat the formation, a tremendous amount of electrical energy is needed. This tremendous amount of electrical energy is needed because the prior art methods provide for an essential preheating of the entire formation before the driving fluid is injected. Additionally, there is a considerable amount of energy loss due to the fact that the electrical currents do not necessarily flow in straight paths from one electrode to another. Many times, the overburden or underburden above and below the formation containing the viscous material will have a lower electrical resistance than the formation, itself. Thus, the electrical current will enter the overburden or underburden and will travel between the electrodes. Of course, when the electrical current travels through the overburden or underburden, little or none of the desired heating of the viscous material within the subterranean formation is obtained.

Prior art techniques for electrically preheating viscous material contained within subterranean formations also have resulted in other problems because of high current flows in localized areas around the electrodes. It has been found that the areas generally surrounding the electrodes in the prior art methods become overheated and, in some instances, the electrodes, themselves, will melt or be burned away, due to this excessive heat.

Probably, one of the most difficult problems to cope with in the conventional, electrical preheating of subterranean formations is in the area of ultimate recovery of the tar or viscous oil components from the subterranean formation. Specifically, conventional electrical preheating of the subterranean formations will take place in a generally straight line between the injection and production wells. Then, when a driving fluid is injected into the formation or when a fire flood is started in the formation, the tar or viscous oil components laying along this generally straight line between the injection and production wells will be removed from the formation first. The tar or viscous oil materials located away from this straight line between the injection and production wells is extremely difficult to remove and, in many cases, is impossible to remove.

In addition to the foregoing problems that are experienced with conventional methods for electrically preheating subterranean formations, it is also well known that such conventional techniques require an unusually long period of time to properly preheat the formation for ultimate recovery of the viscous material therefrom. It is not unusual for preheating to be carried out for a matter of months or years in order to preheat a subterranean formation to a point where the viscosity of the materials contained therein is reduced to a level where production can begin using such known techniques. Such prolonged preheating periods make such conventional methods unattractive from an economic standpoint for the commercial production of viscous materials.

In view of the foregoing problems and deficiencies of the prior art methods for recovering viscous materials from subterranean formations, it is, of course, highly desirable to develop improved techniques for such recovery.

SUMMARY OF THE INVENTION

Accordingly, it is an object of this invention to provide an improved method for producing viscous materials from subterranean formations. It is another object of this invention to provide an improved process for selectively preheating a portion of a subterranean formation that contains viscous materials to allow for the ultimate recovery of substantially all of such viscous materials. It is yet another object of this invention to provide an improved process for recovery of viscous materials from subterranean formations that utilize less energy and can be carried out in a faster period of time.

Other aspects, objects and advantages of this invention will be apparent to those skilled in the art from the following disclosure and appended claims.

It has been found that viscous materials can be recovered from subterranean formations more efficiently and more readily than the prior art methods by carrying out a series of steps wherein a plurality of at least two wells are drilled and completed from the surface into the subterranean formation for production of the viscous material from the subterranean formation. At least one of the wells is completed as an injection well and at least one of the wells is completed as a production well. A plurality of spaced apart electrode wells are also drilled from the surface into the subterranean formation with the electrode wells being arranged in at least one line with the line generally defining a path between the production well and the injection well with the length of the path being substantially greater than the distance between the production well and the injection well. The distance between each adjacent pair of electrode wells is substantially less than the distance between the injection well and the production well. Following the drilling and completion of the injection well, the production well and the various electrode wells, a voltage is applied across each adjacent pair of electrode wells to thereby cause an electrical current to pass through the subterranean formation between said adjacent pairs of electrode wells. As the electrical current passes through the subterranean formation between the adjacent pairs of electrode wells, the formation is heated in the vicinity of the path defined by the line of electrode wells which results in the lowering of the viscosity of the viscous material along the path. Following the heating of the viscous material to lower its viscosity along the path defined by the line of electrode wells, a driving fluid can be injected through the injection well into the subterranean formation. As the fluid migrates along the path of the material having a lowered viscosity, it will tend to push or propel the material having a lowered viscosity toward the production well. By continued injection of heated or miscible driving fluid through the injection well, additional viscous material can be produced through the producing well with the eventual production of substantially all of the material from the subterranean formation. By properly defining the line of electrode wells to produce a continuous path between the injection and producing wells with a portion of the path being a substantial distance away from the straight line between the injection and production wells, the viscous material that would normally be most difficult to be recovered with conventional recovery techniques can be recovered first with ultimate recovery of substantially all of the viscous material laying within the area between the periphery of the path and the straight line joining the production and injection wells.

DESCRIPTION OF PREFERRED EMBODIMENTS

Figure 1:
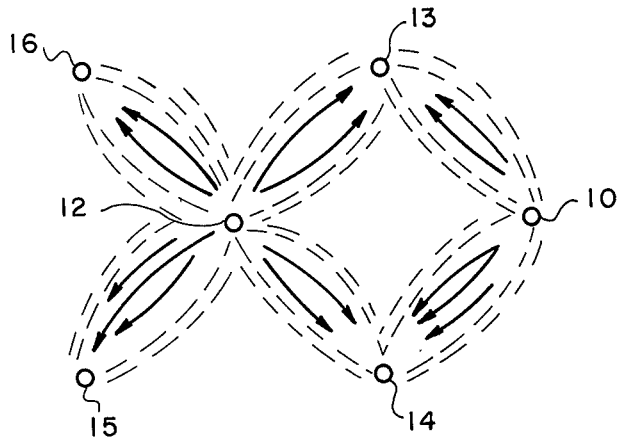
FIG. 1 PRIOR ART
FIG. 1 is a plan view of a typical pattern of production and injection wells according to the prior art illustrating flow paths experienced within the subterranean formation that contain viscous materials such as tar and heavy oil components.

The preferred embodiments and advantages of this invention can best be described by referring to the drawings. FIG. 1 represents a plan view of a conventional pattern of injection wells 10 and 12 which have been drilled into a subterranean formation that contains a viscous material such as a tar contained within a tar sand. The conventional pattern also includes production wells 13 through 16. These wells are also drilled into the subterranean formation and are utilized to bring the viscous material to the surface after it is pushed through the formation or dissolved from the formation by the injection of either a driving fluid or a miscible fluid that is injected through injection wells 10 and 12. In accordance with prior art processes such as those illustrated and described in the aforementioned patents, all of which are incorporated herein by reference, suitable electrodes are lowered into each of the injection wells and production wells and a voltage is applied across the electrodes whereby current flows through the subterranean formation. As the current flows through the subterranean formation, the formation is heated and the viscous material contained therein is also heated to a point where its viscosity decreases to a point where it will flow. In accordance with the prior art processes mentioned above, it is necessary to provide the current flow through the formation for long periods of time of up to several years in order that the viscous hydrocarbon materials within the subterranean formation are heated to a point where they will flow. Because of the long distances that exist between the electrodes and these prior art methods, a substantial amount of electrical energy is lost into the surrounding overburden and underburden of the subterranean formation.

As shown in FIG. 1, the dotted lines between injection well 10 and production wells 13 and 14 illustrate the path of current flow within the subterranean formation as a voltage is applied across injection well 10 and production well 13 and across injection well 10 and production well 14. Likewise, the dotted lines also illustrate the direction of current passage as voltage is applied across injection well 12 and production well 13, across injection well 12 and production well 14, across injection well 12 and production well 15 and across injection well 12 and production well 16. It will be appreciated and acknowledged by the prior art that at best, heating of the subterranean formation by the prior art methods is a slow process that involves an extremely large amount of electrical energy. This, of course, is because the electrodes are spaced a substantial distance apart. Additionally, it will be appreciated and acknowledged by the prior art that the preheating process is carried out slowly and, in some instances, must take as long as several years in order to heat the subterranean formation to a sufficiently high temperature to lower the viscosity of the materials contained within the formation to a point where they can be driven through the formation. Such long heating periods render the prior art process unattractive because large capital investments and operating costs are involved for a long length of time with no return because production does not start for a matter of years in some instances. As illustrated in FIG. 1, the heating of the subterranean formation occurs along the dashed lines of current flow between the electrodes positioned in the injection wells and the production wells. It will be appreciated also from FIG. 1 that an extremely large area of the subterranean formation has current passing through it and is, thus, heated at least to some degree during the preheating process. As acknowledged by the above-mentioned patents, the current may be from a few hundred to a thousand or more amperes between the electrodes of the prior are processes and such current must be maintained for up to several years for the desired preheating to be accomplished.

As soon as the preheating has been accomplished, the current flow is generally discontinued and a driving fluid is injected into the formation through injection wells 10 and 12. The purpose of injecting the fluid into the wells is to force or carry the viscous material from the subterranean formation into production wells 13 through 16 where it can be raised to the surface and further processed. Several types of driving fluid such as hot water, steam, hot gas, has been suggested as a suitable driving fluid. Additionally, miscible fluids that at least partially dissolve the viscous materials can also be injected through the injection wells to carry the viscous material to the surface through production wells 13 through 16.

In FIG. 1, the heavy lines with arrows indicate the initial flow of the driving fluids from the injection wells 10 and 12 toward production wells 13 through 16. Unfortunately, the driving fluid that is injected into the subterranean formation seeks to follow the shortest path between the injection well and the production well. As a result, the injection of driving fluids through injection wells 10 and 12, as illustrated in FIG. 1, will effectively remove most of the viscous material along and adjacent the lines between the injection and production wells as shown by the heavy lines with arrows, but the viscous material lying outside of these lines is difficult and virtually impossible to recover. From this, it is seen that the prior art methods for removing viscous material from subterranean formations removes the viscous material that is most easily recoverable first and a substantial amount of the viscous material is left in the formation since the driving fluid will channel or move through the formation along a line between the injection well and the production well. By this channelizing, or movement along the line between the injection well and the production well, large pockets or areas of the viscous material will remain in the formation.

The instant invention solves many of the problems of the prior art methods for recovering viscous materials from subterranean formation by a unique arrangement of a plurality of closely spaced electrodes within the subterranean formation. The closely spaced electrodes within the formation provide for a selective heating of only a small portion of the underground formation whereby the viscous material will be preheated to lower its viscosity to a point where it will flow along a line or path that is defined by the plurality of electrodes within the formation. By properly arranging the electrodes in a line or path that is substantially longer than the distance between the production and injection wells, a long path of heated viscous material can be established with relatively small amounts of electrical energy in a relatively short length of time. Once the narrow path of viscous material is preheated, injection of the driving fluid can begin and such injection will sweep around the periphery of the path to remove the most difficult to recover viscous material first followed by the removal and the recovery of what is normally the most easily recovered viscous material. This procedure allows for substantially full recovery of the viscous material from the subterranean formations.

Figure 2:
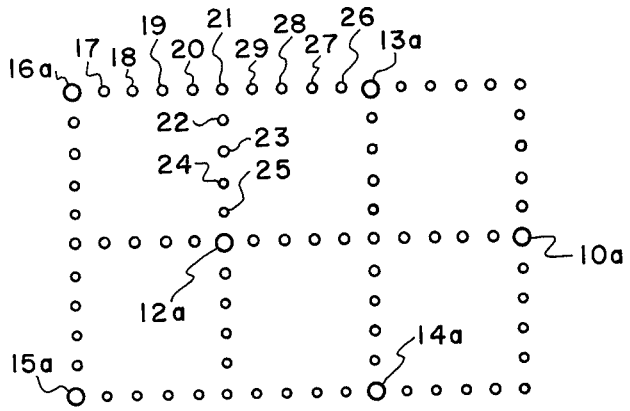
FIG. 2 is a plan view of a pattern of production and injection wells and electrode wells according to this invention.

FIG. 2 is a plan view of one of the preferred embodiments of this invention showing the placement of injection wells 10*a* and 12*a* which are drilled and completed from the surface into the subterranean formation that contains the viscous material to be recovered. Production wells 13*a*, 14*a*, 15*a* and 16*a* are also drilled and completed from the surface into the formation that contains the viscous material to be recovered. It should be noted that the spacing and placement of the production wells and the injection wells in FIG. 2 are substantially the same as those of the prior art method of FIG. 1. In the instant invention, a plurality of electrode wells are drilled from the surface into the subterranean formation with the electrode wells being arranged in lines that generally define a path that connects the individual production wells with the injection wells. As shown in FIG. 2, the electrode wells are represented by the small dots which are placed in a line with the individual electrode wells being relatively close together. For example, electrode wells 17 through 25 are arranged in a line that generally defines a path between injection well 12*a* and production well 16*a* with the length of this path being substantially longer than the distance between injection well 12*a* and production well 16*a*. Likewise, electrode wells 26 through 29 and 21 through 25 define a path between injection well 12*a* and production well 13*a* that is substantially longer than the distance between injection well 12*a* and production well 13*a*. While the other electrode wells in FIG. 2 have not been numbered, it will be noted that they are each represented by the small dots that generally define the paths between the production wells and the injection wells.

Each one of the electrode wells utilized in the instant invention incorporates suitable electrode means that is either in contact with or immediately adjacent the subterranean formation that contains the viscous material to be heated to lower its viscosity for production from the formation. The electrode means can be any conventional electrode means known in the art, such as the electrode means disclosed in the abovementioned patents, which are incorporated herein by reference.

Normally, the production wells 13*a* through 16*a*, as well as injection wells 10*a* and 12*a* will also have electrode means disposed therein or immediately adjacent such injection and production wells.

In carrying out the instant invention, a voltage is applied across each adjacent pair of electrodes whereby current will flow between each adjacent pair of electrodes to heat the subterranean formation along the path defined by the lines of electrodes through the formation. By locating and positioning the electrodes along the lines as illustrated in FIG. 2, each electrode will be located only a short distance from the adjacent electrode. By locating the electrodes relatively close together, it has been found that the amount of electrical energy that must be passed through the formation between the adjacent electrodes to heat the formation therebetween is relatively small. Additionally, by placing the adjacent electrodes close together, most of the problems of electrical energy being dissipated into the overburden and underburden above and below the formation are eliminated. Thus, the spacing of the electrodes close together results in a much greater efficiency of electrical energy usage in heating the subterranean formation.

Any suitable means known in the art for applying a voltage across the adjacent pairs of electrodes in the illustrated system can be utilized. For example, the configuration of production, injection and electrode wells illustrated in FIG. 2 can be adapted to utilize either alternating or direct electrical current to impose the desired voltages across each adjacent pair of electrodes. In the configuration of FIG. 2, for example, when direct current is utilized, the electrode in production well 16*a*, as well as electrode wells 18, 20, 22, 24 and injection well 12*a* can be connected to the positive terminal of a DC source and electrode wells 17, 19, 21, 23 and 25 can be connected to the negative terminal of the DC source. Likewise, production well 13*a*, electrode wells 27 and 29 can also be connected to the positive terminal of the DC source. It will, of course be appreciated that the remaining production and injection wells, as well as the electrode wells shown in FIG. 2, can be similarly connected to the positive and negative terminals of the DC source whereby current will flow between each adjacent pair of the electrodes. Normally, however, it is preferred to utilize an alternating current electrical source. In such instances where alternating currents are utilized, single phase electrical current can be utilized with each alternating electrode being connected to one terminal of the AC source while the remaining electrodes are connected to the other terminal of the AC electrical source. By utilizing such connections, it will be appreciated that a voltage will be applied across each adjacent pair of electrodes and current will flow between each adjacent pair of electrodes to thereby selectively heat the subterranean formation along the path defined by the lines of spaced-apart electrode wells.

The spacing of the electrodes within the subterranean formations along the lines to define the paths between the production wells and the injection wells is preferably as close as economically justified by the cost of installing the electrodes within the formation and the amount of electrical energy that must be supplied to the subterranean formations to accomplish the desired heating between the adjacent electrodes. Normally, electrode spacings of up to about 100 feet are utilized in a ten-acre, five spot pattern of production wells and injection wells. As mentioned above, however, the spacing of the electrodes will be determined by certain economic factors, including the cost of installing the electrodes, as well as the cost of electrical energy that is necessary to accomplish the desired heating between the electrodes.

By closely spacing the electrodes as mentioned above in the instant invention, a substantial reduction in the total amount of electrical energy that is necessary to promote production of viscous materials from the subterranean formation is accomplished. When the electrodes are spaced, as mentioned above, it has been found that only about ten percent of the electrical energy normally utilized in prior art methods is necessary for promoting production in accordance with this invention. An additional advantage is realized in the instant invention, which is that the duration of the preheating is substantially reduced. In some prior art methods, such as is illustrated in FIG. 1, heating times of up to five years or more are necessary to promote production of the viscous material from the subterranean formations. In the instant invention, however, the heating times can be substantially reduced to a matter of days by closely spacing the electrodes. Therefore, it will be appreciated that by reducing the amount of electrical energy to the order of 10 percent and by reducing the preheat times to about ninety days, results in substantial savings in the production of viscous materials in accordance with this invention.

Figure 3:
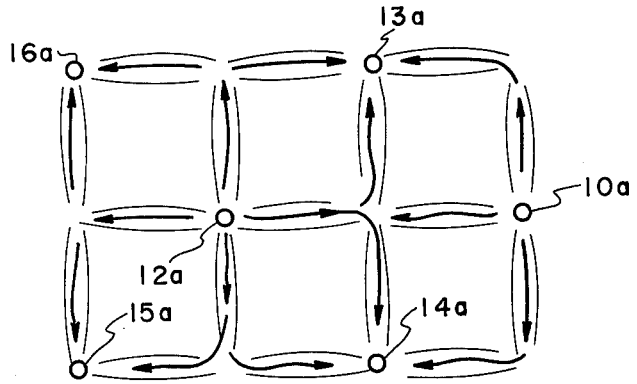
FIG. 3 is a plan view of the pattern of wells illustrated in FIG. 2 showing the initial migration and flow of driving fluid in the subterranean formation as production is initially begun.

FIG. 3 has been included to show the initial flow patterns of the driving fluids as they are injected through injection wells 10*a* and 12*a* by preheating the formations along the paths formed by the lines of closely spaced electrodes. The viscous materials along such paths are reduced in viscosity to a point where they will flow along such paths. The heavy lines indicate the flow paths of the driving fluids as they are injected through injection wells 10*a* and 12*a*. It will be noted that the flow path of injected fluid from injection well 12*a* to production well 16*a* is generally along the path of the electrodes from injection well 16*a*, electrode wells 17 through 25 to injection well 12*a*. Likewise, the path of flow of the driving fluid generally follows the heated paths through the subterranean formation defined by the electrodes within the formation. It will be appreciated that such a flow path, in essence, moves the viscous materials that are normally most difficult, if not impossible, to recover toward the production well first.

Figure 4:
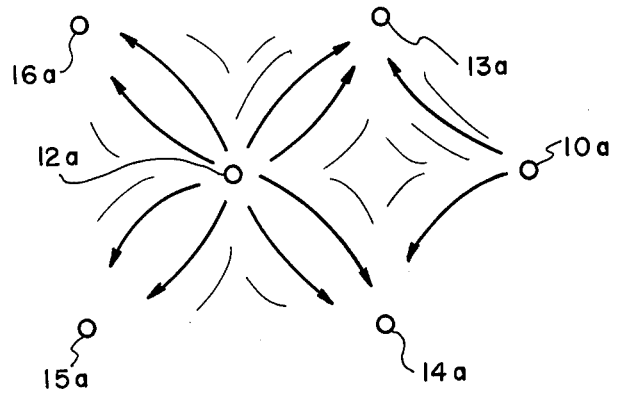
FIG. 4 is a plan view of the production and injection wells of FIG. 2, showing the flow of driving fluid and viscous material within the subterranean formation after substantially all of the viscous material has been removed from the formation.

As previously mentioned, the tendency of the driving fluid to follow the closest route possible from the injection well to the production well will cause the driving fluid to sweep away the viscous material at the corners of the electrode path, as in the corner immediately adjacent electrode well 21. Such a sweeping action will gradually sweep away the viscous material in the areas of the corners as the driving fluid tends to move more closely to the line between the injection well 12*a* and production wells 13*a* and 16*a*. As shown in FIG. 4, this sweeping action will gradually sweep more and more of the viscous material toward the production wells. In FIG. 4, the heavy lines with arrows indicate the flow patterns of the driving fluid as production continues. As more and more driving fluid is injected into the formation, substantially all of the viscous materials can be recovered from the formation. It will be appreciated from an examination of FIGS. 3 and 4, that the viscous materials that are normally most difficult to recover, i.e., the materials most distant from both the injection wells and the production wells, are recovered first. Thereafter, the materials that are most easily recoverable are produced last in the instant invention.

Any suitable type of driving fluid, such as steam, hot water, hot gases, miscible driving fluids that dissolve the viscous materials, and the like, can be utilized in the instant invention. Additionally, the instant invention can be utilized to preheat a subterranean formation for a fire flooding process wherein at least a portion of the viscous material is burned in situ and wherein an oxygen containing material is injected through the injection wells to cause a flame front to move through the subterranean formation that contains the viscous materials to be recovered.

Any of the conventional types of electrodes known in the art can be utilized in the instant invention. However, it will be appreciated that many of the conventional electrodes that have previously been disclosed by the prior art are relatively costly in that they are formed by a very costly process of drilling a conventional well, such as a production or injection well and, thereafter, incorporating a rather elaborate electrode system therein. To reduce the cost of the plurality of electrodes that are utilized in the instant invention, several techniques have been developed for installing the temporary or expendable electrodes that are utilized to form the lines of electrodes as mentioned above. For example, in a very simple embodiment, a well bore can be drilled from the surface down into the subterranean formation and a suitable electrode such as a metallic electrode connected to an electrical conductor can be simply inserted into the formation. Additionally, an insulated casing such as a plastic coated metallic casing, can be run into the well bore and the metallic casing can be utilized to conduct electrical energy downwardly along the casing to an uninsulated portion of the casing in the area of the subterranean formation containing the viscous material. In some instances, it may be desirable to fill such a casing with an electrolyte, such as a brine solution and the electrical energy can be conducted downwardly through the electrolyte into the area of the subterranean foundation.

Figure 5:
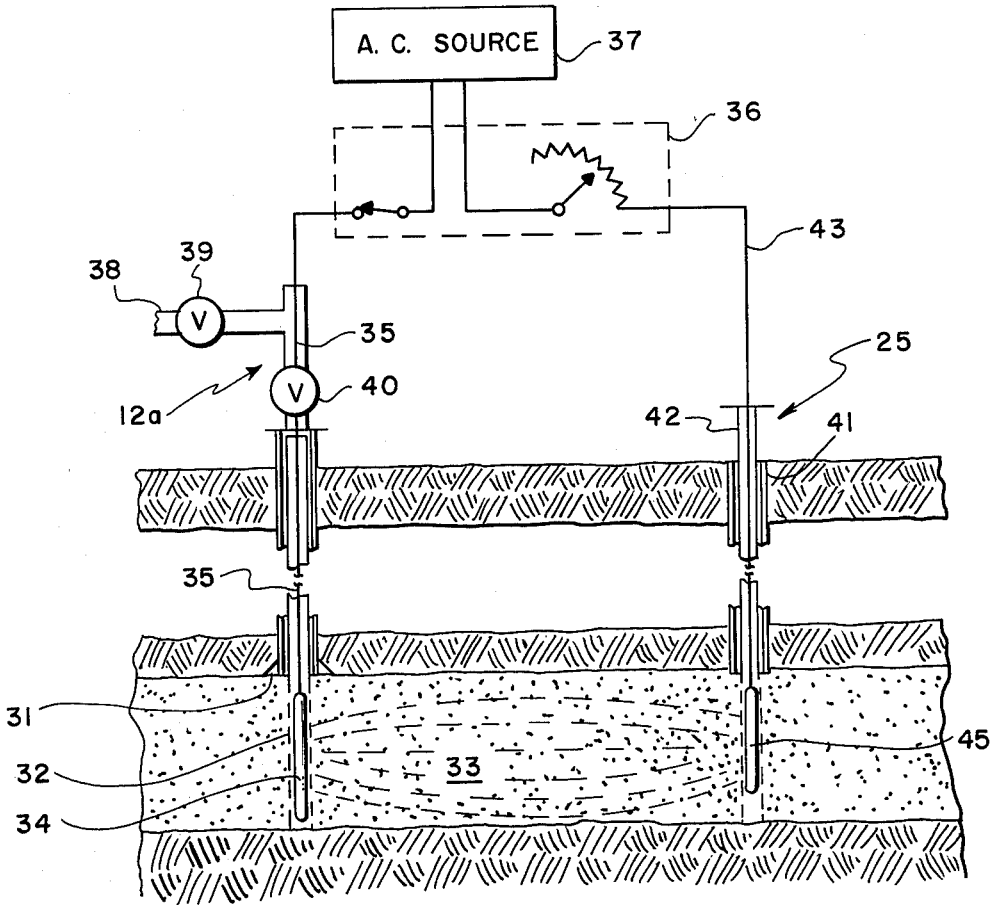
FIG. 5 is a side elevational view, partly schematic and partly sectional, illustrating one of the preferred embodiments of this invention.

FIG. 5 is a sectional view of injection well 12*a* and adjacent electrode well 25. Injection well 12*a* is essentially the same as one of the production wells in that a string of casing 30 has been inserted in the drilled bore hole and cemented in place with the usual foot 31. A perforated conduit 32 extends into the subterranean tar sand formation 33. Preferably, the perforated conduit 32 includes a lower electrically insulated conduit for constraining the electrical current flow to the subterranean tar sand formation as much as practical. The perforated conduit 32 may be a casing having the same or different diameter from casing 30. In the illustrated embodiment, perforated conduit 32 comprises a string of conduit extending from the surface for better reserving the heat content of the injected hot driving fluid which is injected through the well.

Electrode 34 is connected via conductor 35 with surface equipment 36 and a source of electrical current illustrated as an alternating current source 37. Electrical conductor 35 is shown as being insulated between electrode 34 and surface equipment 36.

As illustrated, well 12*a* is connected with a hot fluid injection system by way of suitable insulated surface conduit 38. The hot fluid injection system can include a conventional boiler system for producing steam in accordance with known methods. Control valve 39 can be utilized to regulate the amount of hot fluid injected into the well. Shut-in valve 40 can also be affixed to the upper end of conduit 32 whereby the entire system can be shut in if desired. By opening control valve 39 and shut-in valve 40, a hot, dry fluid, such as steam, hot water and the like, can be injected down conduit 32 and into tar sand formation 33 after the desired preheating of the tar sand has been completed between the adjacent electrodes. Electrode well 25 can be essentially the same as injection well 12*a*. However, to lessen the cost of the overall system, electrode well 25 is a simplified well having surface casing 41 set with a bore hole drill through the subterranean formation 33. Casing 42 can be a conventional steel casing that is covered externally and/or internally with an insulating plastic. Casing 42 can be run into the hole to extend downwardly into tar sand formation 33 and, if desired, conductive brine can be pumped into the interior of casing 42 and the casing can be cemented into place. If desired, a conductive cable, such as a copper cable 43, can be lowered into the central portion of casing 42 and affixed to a lower electrode 45. The lower end of casing 42, in the area of tar sand formation 33, will normally not be covered with the insulating plastic coating whereby good electrical contact can be made between the conductive casing and the surrounding tar sand formation. In some instances, it may be desired to perforate the lower portion of casing 42 whereby the electrically conductive brine solution can come into intimate contact with the surrounding tar sand formation 33. Thereafter, conductor cable 42 can be suitably affixed to surface equipment 36, which, in turn, is connected to a suitable source of electrical current. In the illustrated surface equipment, conventional rheostats and switches can be utilized to control the amount of current that will be passed through the electrodes.

As the voltage is maintained across the illustrated electrodes, current will flow between the electrodes to thereby heat the portion of the tar sand formation 33 in the path of the current flow. Because of the close spacings of the electrodes, substantially all of the electrical current flows through tar sand formation 33 to thereby heat and lower the viscosity of the tar contained within the tar sand formation. It will be appreciated that FIG. 5 illustrates only one pair of adjacent electrodes and that current flows between these illustrated electrodes as well as to the other adjacent electrodes not illustrated. Thus, current can flow between all of the electrodes illustrated in FIG. 2 simultaneously whereby the subterranean formations are heated along the illustrated paths at the same time.

Because of the inexpensive and simple construction of electrode well 25 in FIG. 5, as soon as the heating is achieved by virtue of the current flow between the adjacent electrode pairs, the casings can be pulled from the wells for reuse and the bore hole can be cemented shut before the actual injection of the driving fluids through the injection wells. In some instances, the cost of the electrode wells may be so small that it is not necessary or even desirable to pull the casings or the electrodes and conductors from the electrode wells before production actually begins.

Figure 6:
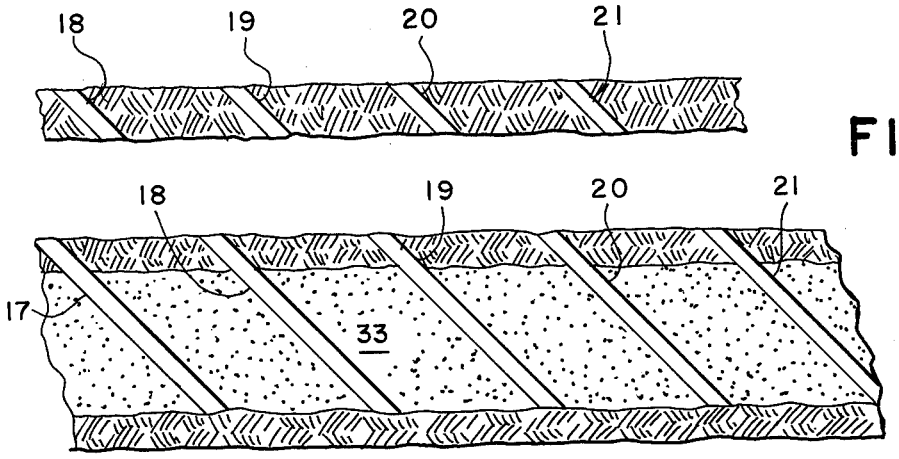
FIG. 6 is a side elevational view, partly schematic and partly in section, illustrating another preferred embodiment of this invention with electrodes being disposed in an angular orientation.

Since it is highly desirable to place the adjacent electrodes as close together as is economically justified to obtain rapid heating of the predetermined portion of the formation, it may be desirable in some instances to place the electrodes in the subterranean formations at an angle to the vertical. For example, as illustrated in FIG. 6, the holes for receiving or forming the electrodes within tar sand formation 33 have been drilled through tar sand formation 33 at an angle of approximately 45°. Several advantages result from the drilling of the electrodes at an angle because the length of the electrode exposed to the tar sand formation is greater. For example, if the electrodes are disposed at an angle of 45°, the effective length of the electrode exposed to the tar sand is approximately 1.4 times the effective length of the electrode if it was drilled vertically through the tar sand formation. Additionally, for a given well separation, the electrodes will be considerably closer to each adjacent electrode when they are angularly disposed in a substantially parallel configuration through the tar sand formation. Thus, when electrode wells are spaced about 100 feet apart and drilled through the tar sand formation at an angle of approximately 45°, the distance between the electrodes within the tar sand formation will be about 71 feet as opposed to the 100-foot distance if they were drilled vertically through the tar sand formation. The longer electrode length and closer spacing, of course, will permit the electrode wells to be drilled further apart with the same heating efficiencies and the same heating times realized as opposed to vertically drilling the electrode holes through the formation. In carrying out a drilling procedure wherein the electrodes are disposed in substantially parallel angular array through the tar sand formation, any known method for angular or slant hole drilling can be utilized.

It will be appreciated that the illustrated embodiments of the invention in FIGS. 2 through 4 have been directed to a conventional "five spot" arrangement of injection and production wells. This process is, of course, applicable to production techniques where other injection and production wells are disposed adjacent to such a five spot pattern. In fact, in large production fields, multiples of the "five spot" pattern will be utilized with many repeating "five spot" patterns being disposed throughout the field whereby injection and production will be taking place simultaneously through all of the numerous injection and production wells.

It will also be appreciated that while a conventional "five spot" pattern has been illustrated to describe some of the preferred embodiments of this invention, this invention can be utilized for the production of viscous materials from as little as two wells with one of the wells being a production well and the other being an injection well with a plurality of electrodes disposed in at least one line with the line generally defining a path between such production and injection well with the length of the path being substantially greater than the distance between the production well and the injection well. It will further be appreciated that, while the illustrated configuration of the lines of electrode wells has been in the form of a right angle path any circuitous or otherwise lengthy path between the injector well and the production well can be utilized. Finally, while much has been said of the deficiencies of the prior art in producing viscous materials along a line directly between the injector well and the production well, this invention is applicable to such a process. In such a conventional process, the plurality of electrode wells can be drilled along a substantial line between the injector well and the production well and preheating of the subterranean formation can be achieved using less current and in a shorter time by using the plurality of electrodes of this invention. However, as stated above, the preferred embodiments of the invention utilize the electrodes in a line that forms a path that is substantially greater than the distance between the production well and the injection well.

As is known by the prior art references, referred to above, current passed through the subterranean formations containing the viscous materials to be recovered may run from a few hundred to 1000 or more amperes at a voltage of from a few hundred volts to as much as 1000 volts or more. Care must be taken to prevent overheating of the subteraneanformations, especially in the area of high current flow which will normally be immediately adjacent the electrodes. Therefore, if current flow begins to increase to a point where overheating occurs, the current flow may be decreased by suitably adjusting the voltage between the adjacent electrodes. Additionally, there may be some desired effects obtained by periodically injecting an electrolyte, such as a brine solution, into the area immediately adjacent the electrodes to assist in the conducting of electrical currents from the electrodes into the adjacent subterranean formations. In some instances, it also may be desirable to pack conductive materials such as granulated carbon, metallic granules and the like, around the electrodes to form a larger area for conducting electrical current into the subterranean formations.

Various changes and modifications may be made in the foregoing disclosure without departing from the spirit and scope of this invention.

I claim:

1. A method of producing a viscous material from a subterranean formation which comprises:

(a) drilling and completing a plurality of at least two wells from the surface into said subterranean formation for production of said viscous material therefrom; at least one of said wells being completed as an injection well and at least one of said wells being completed as a production well, said wells being spaced apart and arranged in a predetermined pattern;

(b) drilling and completing a plurality of spaced-apart electrode wells into said subterranean formation, said electrode wells being arranged in at least one line, said line generally defining a path between said production well and said injection well with the distance between each adjacent pair of electrode wells being substantially less than the shortest distance between said injection well and said production well;

(c) applying a voltage across each adjacent pair of said electrode wells to thereby cause an electrical current to pass through said subterranean formation between said adjacent pairs of electrode wells to preheat said subterranean formation and thereby lower the viscosity of said viscous material along said path formed by said line of electrode wells;

(d) thereafter injecting a fluid through said injection well and into said subterranean formation to migrate along said path formed by said line of electrode wells; and (e) producing said viscous material, having a reduced viscosity from said production well.

2. A method of producing a viscous material from a subterranean formation which comprises:

(a) drilling and completing a plurality of at least two wells from the surface into said subterranean formation for production of said viscous material therefrom; at least one of said wells being completed as an injection well and at least one of said wells being completed as a production well, said wells being spaced apart and arranged in a prdetermined pattern;

(b) drilling and completing a plurality of spaced-apart electrode wells into said subterranean formation, said electrode wells being arranged in at least one line, said line generally defining a path between said production well and said injection well with the distance between each adjacent pair of electrode wells being substantially less than the shortest distance between said injection well and said production well and wherein the length of said path defined by said line of electrode wells is substantially greater than the distance between said production well and said injection well;

(c) applying a voltage across each adjacent pair of said electrode wells to thereby cause an electrical current to pass through said subterranean formation between said adjacent pairs of electrode wells to preheat said subterranean formation and thereby lower the viscosity of said viscous material along said path formed by said line of electrode wells;

(d) thereafter injecting a fluid through said injection well and into said subterranean formation to migrate along said path formed by said line of electrode wells; and (e) producing said viscous material, having a reduced viscosity from said production well.

3. The method of claim 2 wherein said fluid is steam.

4. The method of claim 3 wherein said fluid is hot water.

5. The method of claim 4 wherein said fluid is miscible with said viscous material.

6. The method of claim 2 wherein said electrical current is alternating current.

7. The method of claim 2 wherein an oxygen containing material is injected through said injection well and ignition is initiated within said formation to cause a flame front to move through said formation.

8. In a process wherein a viscous material is produced from a subterranean formation by injecting a driving fluid into an injection well and producing said viscous material from a spaced-apart production well drilled into said subterranean formation, a method of selectively preheating a portion of said subterranean formation which comprises placing a plurality of spaced apart electrodes in said subterranean formation, said electrodes being arranged in at least one line, said line generally defining a path between said production well and said injection well with the distance between each adjacent pair of said electrodes being substantially less than the shortest distance between said injection well and said production well and thereafter applying a voltage across each adjacent pair of said electrodes to thereby cause an electrical current to pass through said subterranean formation between said adjacent pairs of electrodes to preheat said subterranean formation.

9. The process of claim 8 wherein the length of said path defined by said line of electrodes is substantially greater than the distance between said production well and said injection well.

* * * * *